United States Patent [19]

Heskey et al.

[11] Patent Number: 5,074,142

[45] Date of Patent: Dec. 24, 1991

[54] CRIMPING TOOL HAVING A CAM ROLLER BRAKE

[75] Inventors: George T. Heskey, Derry; Urs F. Nager, Jr., Hudson, both of N.H.

[73] Assignee: Burndy Corporation, Norwalk, Conn.

[21] Appl. No.: 588,080

[22] Filed: Sep. 25, 1990

[51] Int. Cl.[5] ..... B25B 27/14; B21D 7/06

[52] U.S. Cl. ..... 72/410; 72/452; 29/751

[58] Field of Search ..... 72/409, 410, 452; 29/751, 753; 81/57.2, 57.18

[56] References Cited

U.S. PATENT DOCUMENTS

| | | | |
|---|---|---|---|
| 3,101,017 | 8/1963 | Malkin | 81/313 |
| 4,433,569 | 2/1984 | Santinelli | 72/410 |

*Primary Examiner*—Daniel C. Crane

*Attorney, Agent, or Firm*—Partick J. Walsh; Burtsell J. Kearns

[57] ABSTRACT

A cam roller brake for a crimping tool for electrical connectors having a cam actuated toggle mechanism for operating crimping jaws in which the roller brake regulates movement of the cam in precise crimping cycles.

6 Claims, 3 Drawing Sheets

CRIMPING TOOL HAVING A CAM ROLLER BRAKE

BACKGROUND OF THE INVENTION

The invention relates to crimping tools, particularly manually operated crimping tools. Specifically the invention relates to a cam roller brake for such crimping tools.

Manually operated crimping tools for affixing connectors to electrical wires utilize a cam actuated toggle mechanism for opening and closing crimping jaws which establish the connection. It is desirable to manipulate the toggle mechanism in distinct crimping cycles measured by one full rotation of the actuating cam. That is, the cam should at the end of each cycle return to a home or start position with the crimping jaws at maximum opening. Because of the very substantial forces developed between the cam and toggle mechanism there is a tendency for the cam to rotate past the home or start position when unloading a crimp and come to rest at a point in the next crimp cycle. This problem is described in U.S. Pat. No. 3,101,017 wherein the jaws and toggle when compressed to their closed or crimp position store energy in the manner of a spring. When unloading a crimp the actuating cam releases the cam follower, the toggle and jaws assembly, and they release their stored energy driving the follower against the cam. The result is a tendency to drive the cam past its home or start position into the next crimping cycle.

To overcome this tendency, the crimping tool of the '017 patent utilizes a friction braking mechanism consisting of a leather lined spring steel band to control rotation of the cam by counteracting the force exerted by the cam roller on the cam when the crimp is unloaded and the cam begins its return to the home position. The friction band brake mechanism is limited to smaller jaws resulting in a limitation in the range of connectors handled by the crimping tool. It has been determined that the existing brake mechanism is not effective with larger crimping jaws which are necessary to deal with a wider range of connectors.

The higher crimping forces associated with larger crimping tools accelerate the cam causing it to spin very rapidly when a crimp is unloaded so that the cam is positioned well into the next crimp cycle where the jaws are partially closed. The problem is amplified considerably if the crimping tool has been immersed in oil because the friction brake band is virtually useless when lubricated. Under these circumstances the operator cannot remove the tool from the crimp connection. The tool must then be disassembled which is an unacceptable situation.

SUMMARY OF THE INVENTION

The present invention provides a new braking mechanism for crimping mechanisms particularly for crimping tools having large jaws to accommodate a wide range of electrical connectors.

In a cam actuated toggle mechanism according to the present invention, the cam profile is a logarithmic spiral or constant pressure angle curve which controls the motion of a cam follower forming part of the toggle mechanism providing an extremely high mechanical advantage so that the input force is multiplied by a factor theoretically (but not practically) approaching infinity. Beginning from a home position the cam in engagement with the cam follower rotates through the crimp cycle of approximately 277 degrees to develop maximum crimping pressure at the crimping jaws. Thereafter the cam rotates approximately 14 degrees to bring about a gradual unloading of the crimp. Next, the cam rotates through an angle of approximately 69 degrees returning to the home position while there is rapid unloading of the crimp and acceleration of the cam toward the home position. By reason of the force exerted on the cam by the cam follower there is a tendency of the cam to roll past the home position. According to the present invention an elastomeric roller is placed in engagement with the cam follower at a location to exert a force on the cam in a direction to counteract the force exerted on the cam by the cam follower. The elastomeric roller compresses and exerts maximum force on the cam during the time the cam rotates from a position of maximum crimp back to the home position as the crimp is being unloaded. Thus the elastomeric roller effectively reduces the rotation caused by the cam follower by utilizing potential or strain energy rather than friction. While the initial moment arm exerted by the roller on the cam is large, it decreases as the cam approaches the home position and as the force exerted by the roller increases. By balancing the compression of the roller with the crimping force, cam overtravel can be controlled and the cam does not advance into the next crimp cycle.

OBJECTS OF THE INVENTION

It is an object of the invention to provide a braking device for crimping tools which does not rely upon friction.

It is a further object of the invention to provide a brake for crimping tools having cam actuated toggle mechanisms in which a brake controls rotation of the cam when the crimp is unloaded, prevents cam rotation beyond its home position and does not rely upon friction to do either.

A further object of the invention is to provide an elastomeric roller which engages the cam and exerts maximum force on the cam to counteract an accelerating force of the toggle mechanism during the time the crimp is being unloaded.

Another object of the invention is to provide an elastomeric roller having excellent physical and chemical properties for use as a breaking device.

Other and further objects of the invention will become apparent with an understanding of the detailed description of the invention or will occur to those skilled in the art on employment of the invention in practice.

DESCRIPTION OF THE DRAWINGS

A preferred embodiment of the invention has been chosen for purposes of illustration and description and is shown in the accompanying drawing in which.

DETAILED DESCRIPTION OF THE INVENTION

Figure 1:
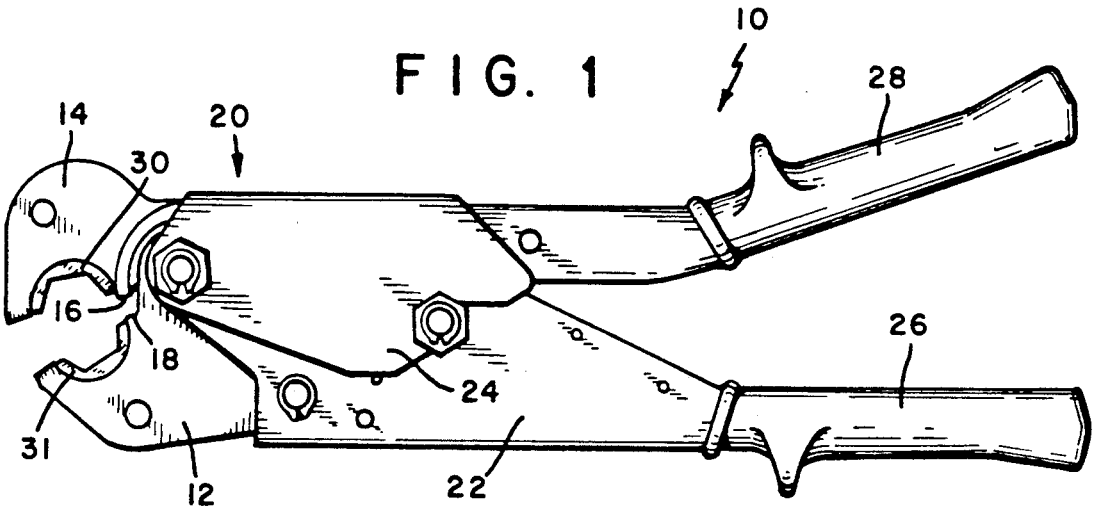
FIG. 1 is a plan view of a crimping tool utilizing a cam roller brake according to the present invention.

The cam, jaws and toggle assembly shown in the drawing forms part of a crimping tool such as that disclosed in U.S. Pat. No. 3,101,017 which describes and claims a crimping tool including operating handle for manipulating the tool in crimping connectors. In the following description there is reference to the '017 patent for defining related tool mechanisms which may be used with the present invention.

Referring now to FIG. 1, a preferred crimping tool 10 includes high strength steel crimping jaws 12, 14 with butt surfaces 16, 18 defining the limits of jaw travel in the crimp position, a central housing 20 including confronting front 22 and rear (not shown in FIG. 1) frame members, a cover 24, a fixed handle 26 and a spring loaded operating handle 28. A set of crimping dies 30, 31 are fitted the crimping jaws. The tool is designed for one hand operation developing a maximum crimping force of 8,000 pounds.

Figure 3:
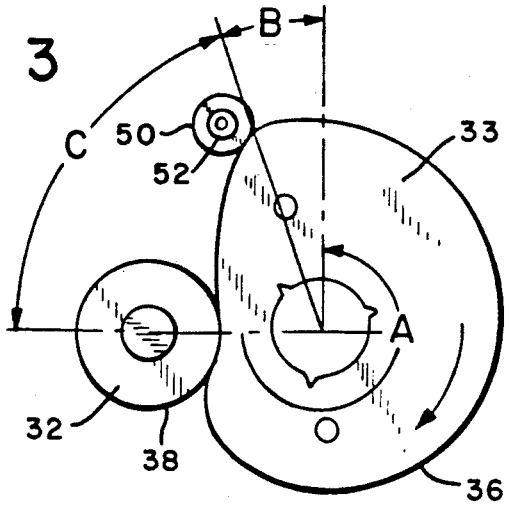
FIG. 3 is a schematic diagram of cam configuration showing angular segments of a crimping cycle and locations of cam follower and elastomeric roller brake.
Figure 4:
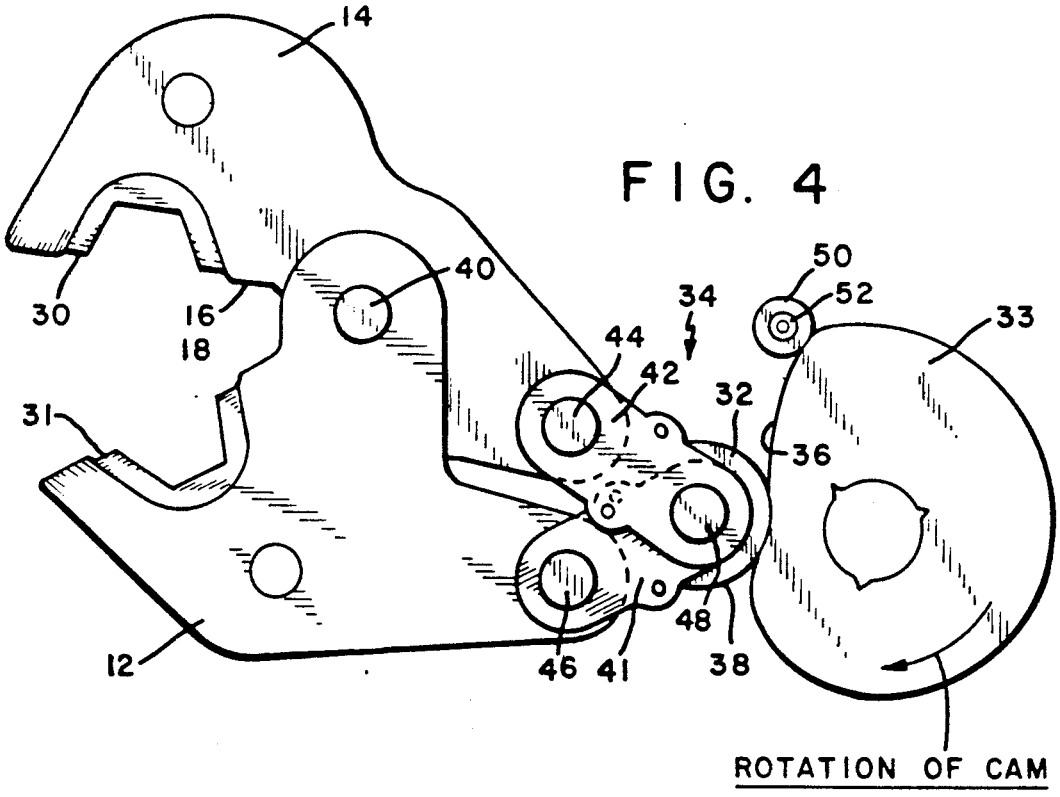
FIG. 4 is a schematic view showing the cam, roller brake, and toggle mechanism of the crimping tool in the home or start position.

Referring to FIGS. 3 and 4 the actuating cam 33 of the crimping tool is located within the central housing and controls a cam follower 32 which forms part of a toggle mechanism 34 for actuating crimping jaws. The cam and follower are shown in the home position; that is, the maximum open position of the jaws in FIG. 4. The rise curve of the cam defined by angle A (FIG. 3) is a logarithmic spiral or constant pressure angle curve in which in travelling through angle A for approximately 277 degrees there is a build up to a maximum crimping force exerted by the cam on the cam follower, toggle and jaws assembly. Angle B of approximately 14 degrees represents the extent rotation of the cam for gradual unloading of the crimp. Angle C of approximately 69 degrees represents the rapid unloading of the crimp and acceleration of the cam to the home position defined by a concave portion 36 of the cam surface corresponding to cam follower surface curvature 38.

Referring to FIG. 4 the crimping tool includes an upper jaw and a lower jaw which are pivotally 40 connected to each other and have jaw dies which cooperate in crimping a connector. Confronting butt surfaces 16, 18 limit the travel of the jaws to the crimped position. As shown in FIG. 4 the jaws are at their position of maximum opening. A toggle mechanism including toggle links 40, 42 pivotally connected to the upper jaw 44 and to the lower jaw 46 and to each other 48. The cam follower 32 is also pivotally 48 connected to the toggle mechanism.

The cam is rotated by any suitable mechanism such as that shown in FIG. 1 the '017 patent comprising a ratchet and pawl mechanism driven by multiple strokes of the operating handle.

Figure 2:
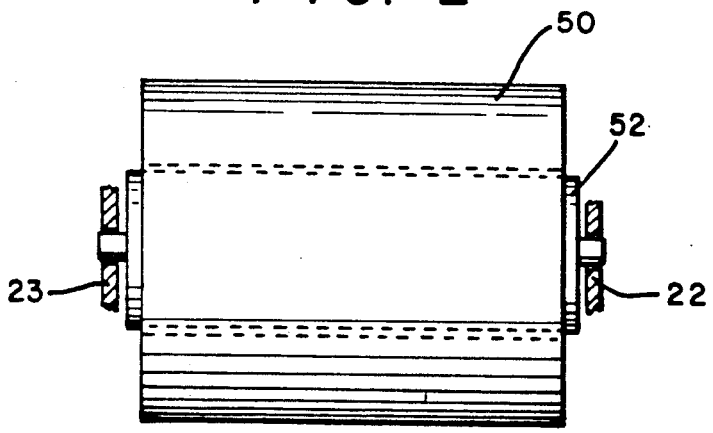
FIG. 2 is a plan view of a cam roller brake according to the invention.

The elastomeric roller 50 shown in FIG. 2 is preferably fabricated of polyurethane which exhibits excellent properties including chemical resistance to hydrocarbons for example, deformation without splitting, elongation without fracture, and wear resistance.

The roller is a tube loosely mounted on a support shaft 52 positioned between supporting front 22 and rear 23 frames within the crimping tool central housing. A roller wall thickness of ¼ inch has been found to provide a suitable breaking action.

In operation of the crimping tool the cam rotates as it actuates the toggle mechanism. The rise portion (angle A) of the rotating cam engages the elastomeric brake in rolling contact gradually compressing the brake up to approximately 50% of its wall thickness at the top of the cam rise. When the roller is fully charged, it exerts a negative or counter clockwise moment on the cam: The roller acts like a spring resisting rolling movement of the cam when the crimp is unloaded and the cam returns to its home position.

Figure 5:
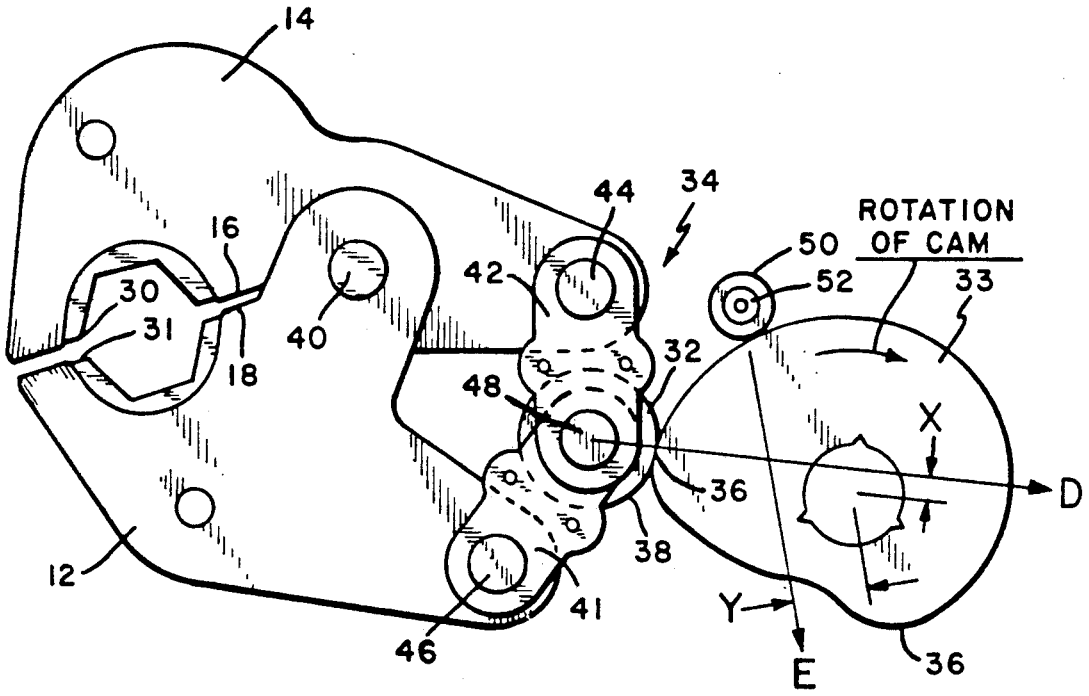
FIG. 5 is a schematic view showing the cam, roller brake, toggle and jaws assembly in the crimp position.

Referring now to FIG. 5, the crimping mechanism is shown in the position of maximum crimp with the jaws closed limited by the engaging butt surfaces. The three toggle pivots are nearly in line in order to develop maximum mechanical advantage. It will be seen that the cam follower exerts a reaction force on the cam in the direction of arrow D establishing a moment arm X about the cam axis in a clock wise direction. This force is very large and will tend to accelerate the cam as the crimp is being unloaded. The elastomeric roller is positioned on the cam surface at the point of maximum crimp to exert a force in the direction of arrow E about moment arm Y in a counter clock wise direction in order to counteract the cam follower force D. It will be observed in FIG. 3 that the elastomeric roller achieves position of maximum pressure in developing the braking force about moment arm Y. While this moment arm is initially small it allows the force to rotate the cam in a counter clockwise sense. As the cam rotates, the moment arm increases while the force decreases. The elastomeric roller is compressed as the cam approaches the crimped position shown in FIG. 5. At this position the force exerted on the cam by the roller is applied in the clockwise direction. The moment arm Y which is greater than moment arm X causes the force to rotate the cam in a counter clockwise sense. This effectively reduces the rotation caused by the follower. While the moment arm Y is initially large it decreases as the home position is reached while the roller force increases. By balancing the compression of the roller with the crimping force cam overtravel is easily controlled and the follower does not advance the cam into the next crimp cycle.

Having thus described our invention, we claim:

1. A crimping tool for affixing connectors comprising a pair of pivotally connected crimping jaws actuated by a toggle linkage between open and crimping positions, a cam follower forming part of the toggle lingage, a cam for engaging the cam follower and applying force to the toggle linkage in order to move the crimping jaws to the crimping position, the cam follower exerting a reaction force on the cam, said cam having an operative surface in engagement with the cam follower including a home position, a rise curve for buildup of maximum crimping force ending in a point of maximum crimp, and an unloading curve for unloading the crimp as the follower returns to home position, an elastomeric roller brake engaging and being compressed by the cam during buildup of the crimping force and positioned to engage the rise curve portion to the point of maximum crimp performed by the crimping jaws, the roller brake engaging the cam surface to exert a force to counteract the cam follower reaction force on the cam as the crimp is unloaded and to control cam follower movement to the home position so the follower does not advance the cam into the next crimp cycle.

2. A crimping tool for affixing connectors comprising a pair of pivotally connected crimping jaws actuated by a toggle linkage between open and crimping positions, a cam follower forming part of the toggle linkage, a cam for engaging the cam follower and applying force to the toggle linkage in order to move the crimping jaws to the crimping position, the cam follower exerting a reaction force on the cam, said cam having an operative surface in engagement with the cam follower including a home position, a rise curve for buildup of maximum crimping force ending in a point of maximum crimp, a first unloading curve for gradually unloading the crimp, and a second unloading curve for rapid unloading of the crimp and return of the follower to home position, an elastomeric roller brake engaging and being compressed by the cam during buildup of the crimping force and positioned to engage the rise curve portion to the point of maximum crimp performed by the crimping jaws, the roller brake being positioned on the cam surface at the point of maximum crimp to exert a force to counteract the cam follower force on the cam band to control cam follower movement to the home position so the follower does not advance the cam into the next crimp cycle.

3. A crimping tool for affixing connectors comprising a pair of pivotally connected crimping jaws actuated by a toggle linkage between open and crimping positions, a cam follower forming part of the toggle linkage, a cam rotatable about an axis for engaging the cam follower and applying force to the toggle linkage in order to move the crimping jaws to the crimping position, said cam having an operative surface in engagement with the cam follower including a home position, a rise curve for buildup of maximum crimping force ending in a point of maximum crimp, an unloading curve for unloading the crimp and return of the follower to home position, the cam follower at the point of maximum crimp exerting a reaction force on the cam establishing a moment arm about the cam axis in a clockwise direction, an elastomeric roller brake positioned on the cam to exert a force about a moment arm in a counterclockwise direction counteracting the cam follower reaction force and to control cam follower movement to the home position so the follower does not advance the cam into the next crimp cycle.

4. A crimping tool as defined in claim 1 in which the roller brake is formed of polyurethane.

5. A crimping tool as defined in claim 1 in which the roller brake is loosely mounted about a supporting shaft.

6. A crimping tool as defined in claim 1 in which the roller brake has a wall thickness of approximately one-quarter inch.

* * * * *